US006837046B2

(12) United States Patent
Gollner

(10) Patent No.: US 6,837,046 B2
(45) Date of Patent: Jan. 4, 2005

(54) CONTROL DEVICE FOR A PROPORTIONALLY ADJUSTABLE HYDRAULIC PUMP AND A VARIABLE DISPLACEMENT PUMP FOR A HYDROSTATIC DRIVE

(75) Inventor: Wilhelm Gollner, Neumunster (DE)

(73) Assignee: Sauer-Danfoss, Inc., Ames, IA (US)

( * ) Notice: Subject to any disclaimer, the term of this patent is extended or adjusted under 35 U.S.C. 154(b) by 129 days.

(21) Appl. No.: 10/202,131

(22) Filed: Jul. 24, 2002

(65) Prior Publication Data

US 2003/0024240 A1 Feb. 6, 2003

(30) Foreign Application Priority Data

Aug. 6, 2001 (DE) ..... 101 38 554

(51) Int. Cl.[7] ..... F16D 31/02
(52) U.S. Cl. ..... 60/443
(58) Field of Search ..... 60/443; 91/382; 74/839

(56) References Cited

U.S. PATENT DOCUMENTS 5,007,805 A * 4/1991 Goade et al. ..... 91/505
5,226,349 A * 7/1993 Alme et al. ..... 91/506
6,283,721 B1 * 9/2001 Gollner ..... 91/506

* cited by examiner

*Primary Examiner*—F. Daniel Lopez

(57) ABSTRACT

A control device apparatus for a proportionally adjustable hydraulic pump of a closed hydraulic circuit, including an axial piston pump adjustable from a zero position in two pivoting directions, with an electro hydraulic valve configuration for the activation of a piston of the hydraulic pump from both sides and with a feedback device, connected to the piston and whereby the angular pivoting position of the piston can be fed back to the valve configuration as a control signal, the valve configuration having a valve for each pivoting direction of the piston, and the feedback device comprising two mechanical feeler elements, each connected to one of the valves and in sliding engagement with the piston in such a way that the feeler elements are actuated when it leaves the zero position.

16 Claims, 5 Drawing Sheets

CONTROL DEVICE FOR A PROPORTIONALLY ADJUSTABLE HYDRAULIC PUMP AND A VARIABLE DISPLACEMENT PUMP FOR A HYDROSTATIC DRIVE

BACKGROUND OF THE INVENTION

The present invention relates to a control device for a proportionally adjustable hydraulic pump of a closed hydraulic circuit and to a variable displacement pump for a hydrostatic drive, the variable displacement pump being actuable hydraulically out of a zero position in two pivoting directions by means of a valve configuration, and the pump being, in particular, an axial piston pump. A valve configuration is provided for the adjustment of the hydraulic pump, serving for the activation of the adjusting piston from both sides.

Conventional electrohydraulic proportional adjustment systems for hydrostatic drives are known in many forms. To control the angle of adjustment of the piston of the variable displacement pump, it is necessary to provide feedback of an adjusting signal to the valve configuration. For this purpose, U.S. Pat. No. 5,205,201, for example, discloses an electrohydraulic proportional adjustment system with a mechanical feedback device between the servo piston and the control valve.

The principle underlying the circuit diagram of an electrohydraulic proportional adjustment system in accordance with the prior art, as disclosed by U.S. Pat. No. 5,205,201, is illustrated in FIG. 1 of the attached drawings. The axial piston pump 1 has a piston 3 that can be adjusted in two pivoting directions and is activated by means of a control spool 2. The control spool 2, for its part, is actuated by means of an electrically adjustable pilot valve 13. This known electrohydraulic proportional adjustment system furthermore has a mechanical feedback device 4, which feeds back the angle of adjustment of the piston 3 to the control spool 2 by means of a control spring 14 and feedback levers 15. This mechanical feedback of the pivoting angle to the control spool is complex in terms of design and furthermore requires a way of adjusting the zero position, this generally being made possible by means of mechanical levers. Not only is the construction of this control device complex but it is also necessary to carry out adjustment of the control spring and of the zero position of the piston, in each case by hand, after assembly in order to make precise control of the piston of the axial piston pump possible. The mechanical feedback levers furthermore result in tolerances in the precision of control, and these can lead to imprecise activation of the axial piston pump.

U.S. Pat. No. 5,881,629 has disclosed another control device for electrohydraulic proportional adjustment of axial piston pumps, in which the angular pivoting position of the piston of the axial piston pump is determined by means of angle sensors, the mechanical feedback device of the device described above thus being completely replaced by sensors. The position signal representing the pivoting angle is supplied by the angle sensors to an electronic control device, in particular a digital computer, by means of which the electrohydraulic valve is controlled, said valve in turn actuating the piston of the axial piston pump. The disadvantage is in each case that such angle sensors are sensitive to the effects of temperature and vibration, with the result that the reliability and precision of such a control device may be greatly impaired in certain areas of application.

DE-A1 43 37 667 also describes a control device of this kind with angle sensors for detecting the pivoting angle of an adjustable hydraulic machine. The same disadvantages occur as in the prior art already described. Moreover, a control device such as a microcomputer or a digital computer is required if angle sensors are used to detect the angular position of the piston of the axial piston pump.

It is therefore an object of the present invention to provide a control device and a variable displacement pump for a hydrostatic drive with electrohydraulic proportional adjustment that is as simple as possible in terms of its design and allows precise regulation or control of the pivoting angle of the piston of an axial piston pump. It is also an object of the present invention to provide a control system for variable displacement pumps that is simple and as economical as possible.

SUMMARY OF THE INVENTION

The invention provides a control device for a proportionally adjustable hydraulic pump of a closed hydraulic circuit, in particular including an axial piston pump that can be adjusted from a zero position in two pivoting directions, with an electro hydraulic valve configuration for the activation of a piston of the hydraulic pump from both sides and with a feedback device, which is connected to the piston and by means of which the angular pivoting position of the piston can be fed back to the valve configuration as a control signal, the valve configuration having a valve for each pivoting direction of the piston, and the feedback device comprising two mechanical feeler elements, each of which is connected to one of the valves and which are in sliding engagement with the piston in such a way that the feeler elements are actuated when it leaves the zero position.

The control device for proportional adjustment of an axial piston pump in accordance with the invention has an electrohydraulic valve configuration for the activation or actuation of a piston of the pump from both sides and a feedback device, by means of which the angular pivoting position of the piston can be fed back to the valve configuration as a control variable. The valve configuration has a valve for each pivoting direction of the piston, and the feedback device has two mechanical feeler elements, each of which is connected to one of the valves and which are in sliding engagement with the piston in such a way that the feeler elements are actuated when it leaves the zero position. The provision of separate valves for each pivoting direction of the axial piston with respective mechanical feeler elements associated with them, which are in sliding engagement with the piston, makes possible an effective piston activation system of extremely simple construction and allows precise adjustment of the zero position of the pivoting piston. When the zero, position is departed from, one of the feeler elements is actuated by sliding guidance on the piston, depending on the pivoting direction, the actuation of the feeler element producing a control signal. This control signal is fed to the valve configuration, which, for its part, actuates the piston hydraulically in the required direction. Each valve of the valve configuration is thus responsible for only one of the two pivoting directions of the piston of the axial piston pump. The recording of the control signal for the angular pivoting position by means of mechanical feeler elements that are in sliding engagement with the piston is extremely precise and does not require complex mechanical or electronic feedback systems. The pivoting motion of the piston of the axial piston pump is reliably recorded by the mechanical feeler elements, even in extreme operating conditions with severe heat or severe vibrations, and is fed to the valve configuration as a control signal. The control device according to the invention thus allows effective control of the angular pivoting position of the axial piston machine in hydrostatic systems, even in difficult operating conditions, by extremely simple means.

According to an advantageous refinement of the invention, the feeler elements are each in engagement with a track designed as an oblique surface, which track is formed on the outside of the piston of the axial piston pump. By means of this simple design configuration of the outside of the piston, a control system for the angular pivoting position that is of mechanically simple construction can be achieved by means of the sliding feeler elements. It is merely necessary to provide an externally accessible oblique track for each of the feeler elements on one side of the piston of the axial piston pump, each feeler element being connected to one of the valves of the valve configuration. By virtue of the arrangement of feeler elements relative to the track on the piston, adjustment of the control device is effected as part of the design, without the need for the feedback device to be adjusted by hand when assembling the valve configuration and the axial piston pump. This saves time and cost in production.

According to another advantageous refinement of the invention, the piston has on its outside two frustoconical feeling portions and a zeroing portion lying between these two portions and extending in a straight line parallel to the pivoting axis of the piston. In this arrangement, the zeroing portion extending in a straight line can be formed by the cylindrical outer wall of the piston, for example. As a result, depending on the pivoting direction, one of the feeler elements is always actuated by the piston itself when the piston departs from the zero position, bringing about the production of a control signal in accordance with the size of the pivoting angle of the piston. The frustoconical design of the feeling portions results in a control signal that is proportional to the angular pivoting position of the piston. When the zeroing portion provided between the two frustoconical feeling portions on the piston is reached, the feeler elements are in engagement with the outside of the piston in such a way that no control signal is produced, with the result that the valve configuration remains unactuated.

According to another advantageous refinement of the invention, the valve configuration is constructed as a single-stage electrohydraulic proportional adjustment system. Thanks to the single-stage construction, only a small number of parts are required in the valve configuration, i.e. two electrically actuable proportional valves in each case, which are connected directly to the mechanical feeler elements. Such a single-stage activation system is very simple and economical in design.

According to another advantageous refinement of the invention, the valve configuration is of two-stage construction and has a pilot control stage. The pilot control stage is, for example, formed by electronically actuable directional control valves, which, for their part, activate the actual actuation valves of the valve configuration by means of a control pressure. The actuation valves are connected to the mechanical feeler elements in such a way that a movement or actuation of the feeler elements by a pivoting motion of the piston of the axial piston pump can be transmitted directly or indirectly to the valves.

According to another advantageous refinement of the invention, the valve configuration has two electrically actuable pressure-reducing valves. These pressure-reducing valves are of simpler construction than the conventional control spools that are generally used in hydrostatic drives, and are thus inexpensive. Each of the pressure-reducing valves is separately responsible for the actuation of one of the pivoting directions of the piston of the axial piston pump.

According to another advantageous refinement of the invention, a separate control system is provided for each valve of the valve configuration for the purpose of adjusting the start of control by the mechanical feedback device. This makes it possible selectively to adjust the start of control for each side separately and to optimize it for each application. The start of control can equally well be set to the same precise value for both sides. The variability of the control of the pivoting position by means of the control device is thereby increased.

The variable displacement pump for a hydrostatic drive with an axially adjustable piston-cylinder unit as claimed in claim 9 can be pivoted out of a zero position in two opposite pivoting directions by means of hydraulic activation, having a control device with a feedback device for feeding back a control signal derived from the pivoting angle of the piston as claimed in any of claims 1 to 8. The variable displacement pump thus has an extremely simple but effective system for feeding back the pivoting angle, thereby significantly improving the proportional adjustment of the axial piston pump. The variable displacement pump is adjusted precisely to the respective zero position desired without the need to provide complex mechanical levers on the piston of the axial piston pump. Moreover, the variable displacement pump is insensitive to external influences, such as heat, vibration or dirt.

According to an advantageous refinement, the variable displacement pump has a zeroing spring within the piston to return the piston to its zero position, the spring force being matched to the force required to move the piston. The valves of the valve configuration are thus provided merely for the active actuation of the piston, the piston being returned to its zero position by the zeroing spring of the zeroing device.

A number of exemplary embodiments of the invention are described below in detail with reference to the attached drawing. In the drawing:

DETAILED DESCRIPTION OF THE PREFERRED EMBODIMENT

Figure 1:
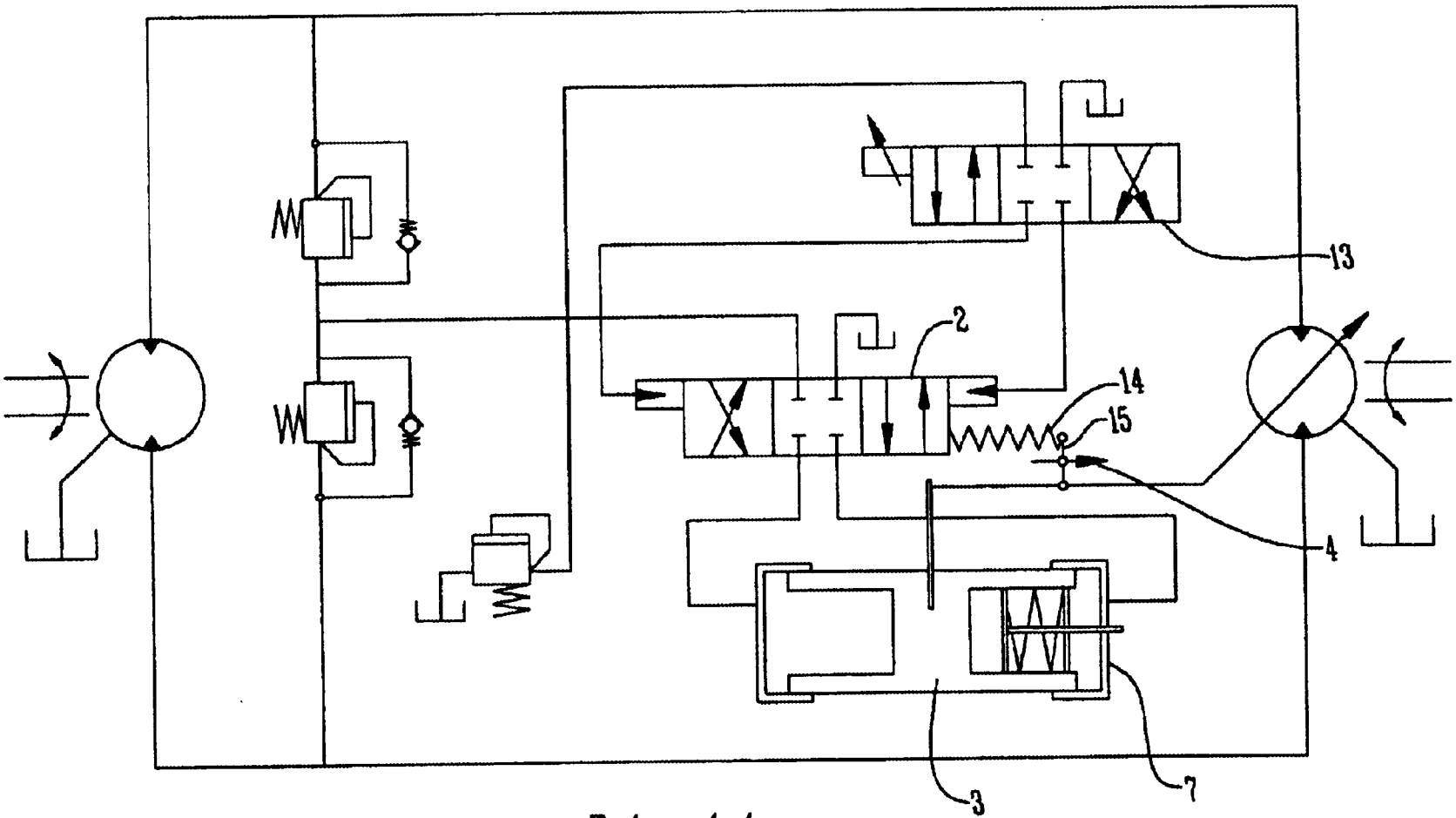
Prior Art Fig. 1
FIG. 1 shows a schematic block diagram of an electrohydraulic proportional adjustment system with a mechanical feedback device in accordance with the prior art.
Figure 2:
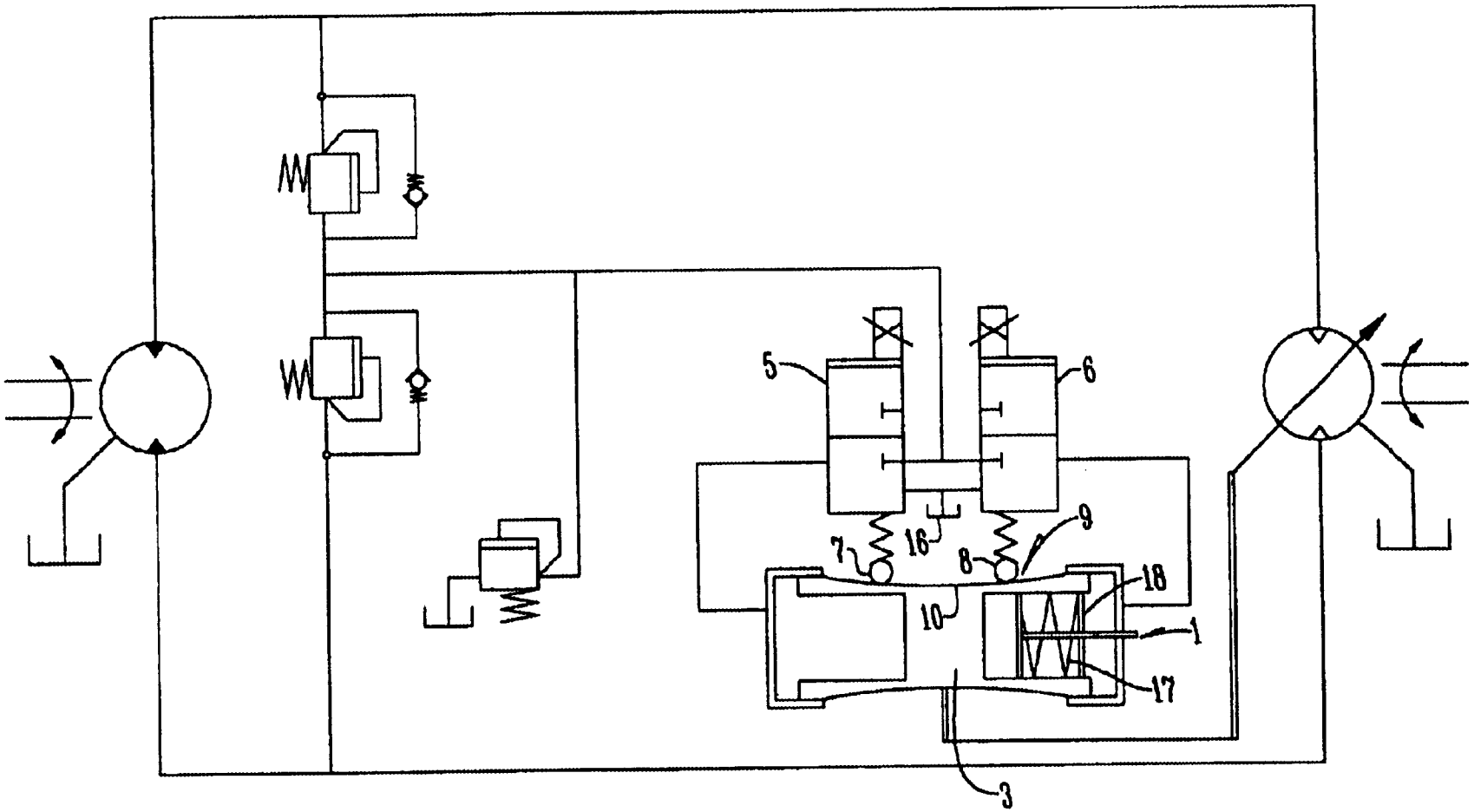
FIG. 2 shows a schematic block diagram of a first embodiment of a control device according to the invention with a single-stage valve configuration.

FIG. 2 shows schematically the operating principle for the activation of an axial piston pump that can be adjusted proportionally by electrohydraulic means and is located in a hydrostatic circuit in accordance with the invention. An axial piston pump 1 is actuated by means of a valve configuration 2 in such a way that the piston 3 of the axial piston pump 1 can be deflected in respectively opposite pivoting directions out of its zero position, which is illustrated in FIG. 2. The valve configuration 2 has two separate valves 5, 6, which in this case are designed as 3/3-way valves or conventional pressure-reducing valves. The valves 5, 6 can be actuated electrically. Each of the valves is connected to a feeler element 7, 8, each feeler element being in sliding engagement with a track 9 on the outside of the piston 3. The feeler elements 7, 8 can be connected mechanically to the valves 5, 6 by means of a spring 14 or, alternatively, connected to them hydraulically by means of a control pressure produced by them. For this purpose, the outside of the piston 3 is constructed with an oblique surface or track for the feeler elements 7, 8, giving rise to frustoconical feeling portions 10, 11 for the feeler elements. The feeler elements 7, 8 are connected to the valves 5, 6 by means of control springs 14 in such a way that a control signal for the angular pivoting position of the piston 3 can be transmitted to the valves 5, 6 via the feeler elements 7, 8 and the control springs 14. As soon as the piston 3 is deflected from its zero position (illustrated in FIG. 2) in one or the other pivoting direction, one of the feeler elements 7, 8 is actuated, and a control signal is produced, or one of the valves is actuated by means of the feeler elements 7, 8 and the control spring 14 in such a way that the piston 3 is acted upon hydraulically and moves back into its zero position. When one side of the piston 3 is activated by one of the valves 5, 6, the other side of the piston is inactive, and the hydraulic line is connected to the tank 16. Since, with this control device according to the invention, the piston 3 is in each case only actuated actively from one side or by one valve 5, 6, a zeroing device 17 is provided within the piston 3. The zeroing device 17 has a zeroing spring 18 with a spring force such that the piston is pivoted back into its zero position by the spring force alone. The piston 3 is connected in a known manner to a variable displacement pump of the hydrostatic circuit.

Figure 3:
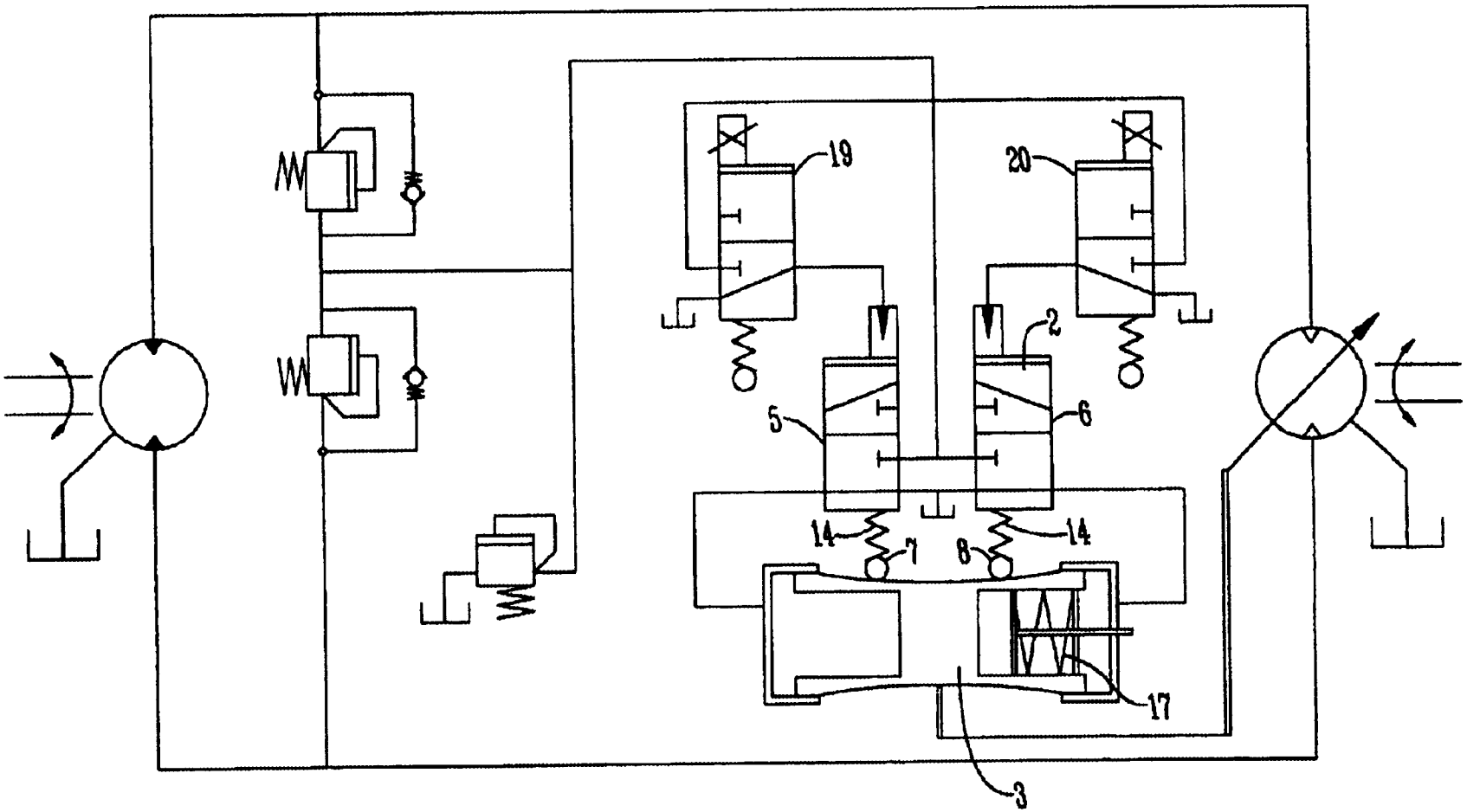
FIG. 3 shows a schematic block diagram of a second embodiment of the invention with a control device with two-stage activation of the piston of the axial piston pump.

FIG. 3 shows a schematic block diagram of a hydrostatic circuit with electrohydraulic proportional adjustment involving a second exemplary embodiment of a control device according to the invention. In contrast to the exemplary embodiment described above and illustrated in FIG. 2, the valve configuration in this exemplary embodiment is provided with pilot control. Two electrically actuable pilot valves 19, 20 produce a hydraulic control pressure, which is supplied in each case to two control valves 5, 6 of the valve configuration. This pilot control pressure serves for the actual actuation of the valves 5, 6 to deflect the piston 3 in its pivoting directions, depending on the desired direction of travel of the hydrostatic drive. Otherwise, the construction and operation of the system are the same as those in the exemplary embodiment shown in FIG. 2. The pilot valves 19, 20 are 3/3-way control valves with electromagnetic actuation. These valves are simpler in construction than the 4/3-way control valves used in conventional hydrostatic drive systems.

Figure 4:
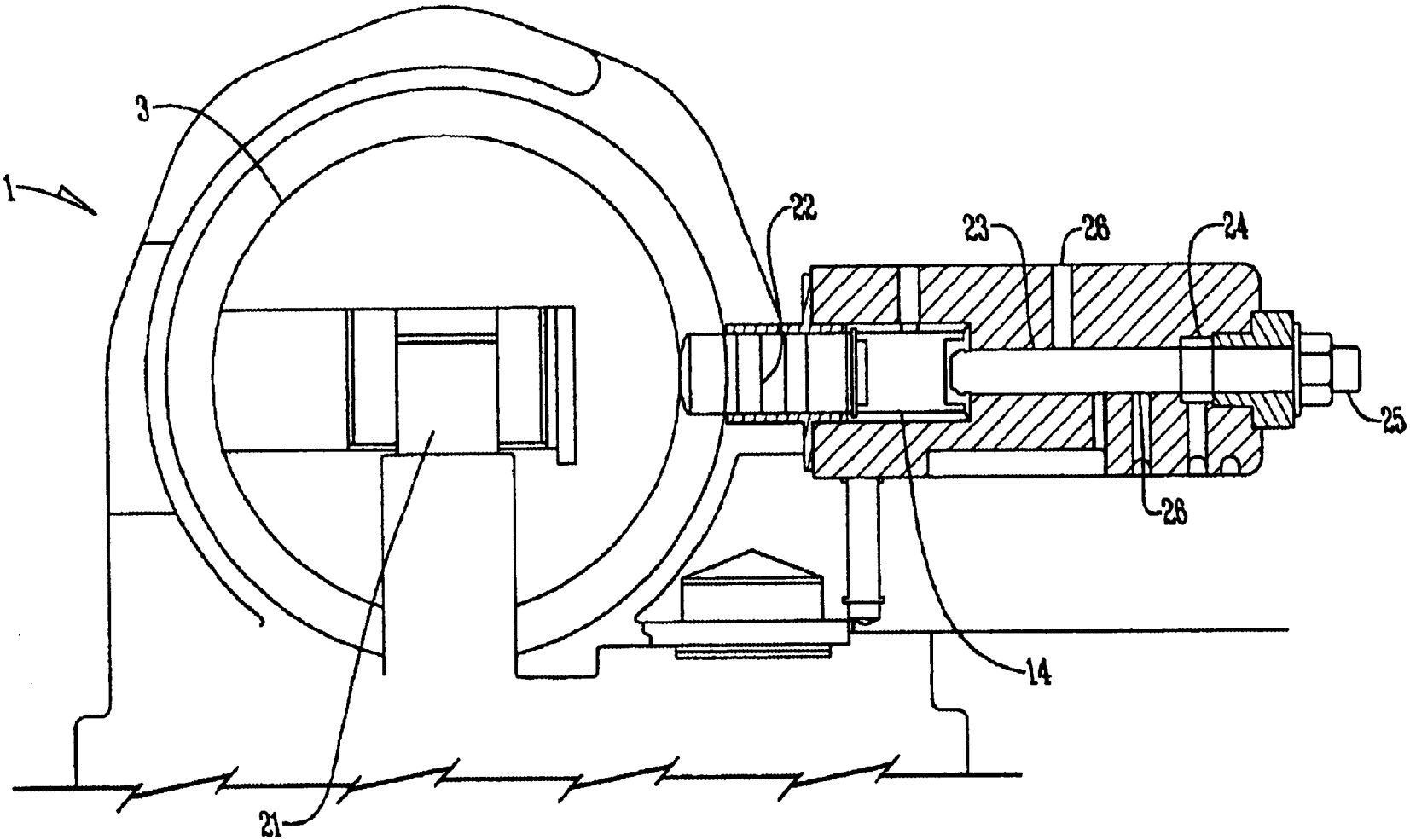
FIG. 4 shows a sectional view of a third embodiment of the invention with a control system for adjusting the start of control.

FIG. 4 shows a sectional view of a design configuration of a third exemplary embodiment of a control device according to the invention. The piston 3 of the axial piston pump 1 is provided with a pivotal connection 21 for the swash plate. At the side of the piston 3, a moveable feeler piston 22 is in engagement with the outside of the piston 3. The feeler piston is acted upon by a control spring 14, which, for its part, is connected to a control piston 23 of the valve configuration. Provided at the rear end of the control piston 23 are an adjusting spring 24 and an adjusting screw 25, by means of which the preloading force of the control spring can be adjusted. A control pressure is passed to the servo piston via the control piston 23 by means of hydraulic control connections 26. In this arrangement, the spring force of the adjusting spring 24 acts on the same side of the control piston 23 as the control signal. This allows the start of control to be set to a very precise value at the factory. This eliminates the need to "learn" the start of control when commissioning the axial piston pump. This is advantageous particularly if the start of deflection of the variable displacement pump in a hydrostatically driven vehicle cannot be detected clearly or appropriate sensors are not available.

Figure 5:
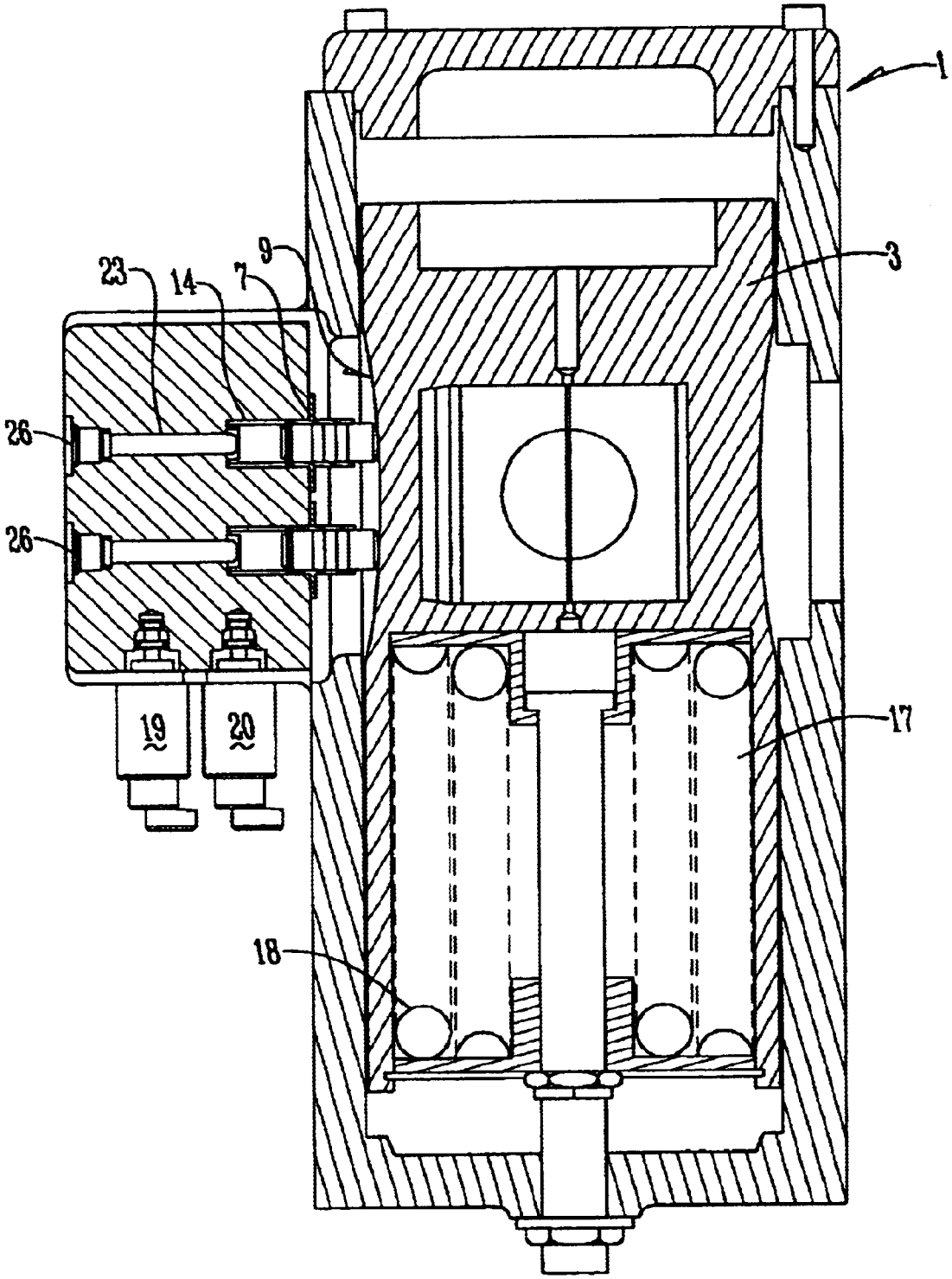
FIG. 5 shows a sectional view of a variable displacement pump according to the invention in accordance with the embodiment in FIG. 3 with a two-stage activation system.

FIG. 5 shows a sectional view of a control device according to the invention with two-stage activation in accordance with the exemplary embodiment shown in the schematic block diagram in FIG. 3. The piston 3 is provided in a conventional manner with a pivotal connection 21 for a swash plate. A zeroing device 17 with a zeroing spring 18 is provided within the piston 3. In FIG. 5, the actuating piston 3 is in its zero position within the cylinder of the axial piston pump 1.

A track 9 for two feeler elements 7, 8 is provided on the outside of the piston, on one side of the latter. Here, the feeler elements 7, 8 are constructed as feeler pistons, each of which is acted upon on the rear side by a control spring 14. For their part, the control springs 14 are connected to a control piston 23, which is activated by means of a hydraulic control signal at the control connections 26. The valve configuration furthermore has a pilot control stage with two pilot valves 19, 20. When the pilot valves 19, 20 are activated, a control signal is passed to the chamber ahead of the control connection 26 of the associated valve 5, 6. The control piston 23 is deflected and transmits a hydraulic signal to the servo piston 3, which is displaced accordingly. This leads to the movement of the feeler piston 7, 8 owing to the oblique track 9 on the outside of the piston 3. As a result, the spring force changes and the control piston 23 is pushed into its neutral position, with the result that the adjusting piston 3 does not move further. The hydraulic signal pressure at the control connection 26 and the force of the control spring 14 are now in equilibrium. In this way, an extremely accurate mechanical feedback device of a proportional control system is achieved, which is not only of extremely simple design but is also distinguished by a high degree of effectiveness.

It is therefore seen that this invention will achieve at least all of its stated objectives.

I claim:

1. A control device for a proportionally adjustable hydraulic pump (1) of a closed hydraulic circuit, comprising an axial piston pump that is adjustable from a zero position in two pivoting directions, with an electrohydraulic valve configuration (2) for the activation of a piston (3) of the hydraulic pump (1) from both sides and with a feedback device (4), which is connected to the piston (3), which back feeds the position of the piston (3) to the valve configuration (2) as a control signal, wherein the valve configuration (2) has a valve (5, 6) for each direction of the piston (3), and wherein the feedback device (4) comprises two mechanical feeler elements (7, 8), each of which is connected to one of the valves (5, 6) and which are in sliding engagement with the piston (3) in such a way that the feeler elements (7, 8) are actuated when it leaves the zero position.

2. The control device as claimed in claim 1, wherein the feeler elements (7, 8) are each in engagement with a track (9) designed as an oblique surface on the outside of the piston (3).

3. The control device of claim 1, wherein the piston (3) has on its outside two frustoconical feeling portions (10, 11) and a zeroing portion (12) lying between them and extending in a straight line parallel to the pivoting axis of the piston (3).

4. The control device of claim 1, wherein each of the feeler elements (7, 8) are held under preload against the piston (3) by a respective control spring (14).

5. The control device of claim 1, wherein the valve configuration (2) is constructed as a single-stage electrohydraulic proportional adjustment system.

6. The control device of claim 1, wherein the valve configuration (2) is of two-stage construction and has a pilot control stage.

7. The control device of claim 1, wherein the valve configuration (2) has two electrically actuable pressure-reducing valves.

8. The control device of claim 1, wherein a separate control system is provided for each valve (5, 6) for the purpose of adjusting the start of control by the feedback device.

9. A variable displacement pump for a hydrostatic drive with a servo system, comprising a piston-cylinder unit having a piston that is selectively moved out of a zero position in two directions by means for hydraulic activation, wherein a control device with a feedback device for feeding back a control signal in accordance with the position of the piston is provided, wherein the piston-cylinder unit is an axial piston pump, wherein the control device comprises, an electrohydraulic valve configuration (2) for the activation of a piston (3) of the hydraulic pump (1) from both sides and with the feedback device (4), which is connected to the piston (3), and which feeds back the position of the piston (3) to the valve configuration (2) as a control signal, wherein the valve configuration (2) has a valve (5, 6) for each direction of the piston (3), and wherein the feedback device (4) comprises two mechanical feeler elements (7, 8), each of which is connected to one of the valves (5, 6) and which are in sliding engagement with the piston (3) in such a way that the feeler elements (7, 8) are actuated when it leaves the zero position.

10. The control device as claimed in claim 9, wherein the feeler elements (7, 8) are each in engagement with a track (9) designed as an oblique surface on the outside of the piston (3).

11. The control device of claim 9, wherein the piston (3) has on its outside two frustoconical feeling portions (10, 11) and a zeroing portion (12) lying between them and extending in a straight line parallel to the pivoting axis of the piston (3).

12. The control device of claim 9, wherein each of the feeler elements (7, 8) are held under preload against the piston (3) by a respective control spring (14).

13. The control device of claim 9, wherein the valve configuration (2) is constructed as a single-stage electrohydraulic proportional adjustment system.

14. The control device of claim 9, wherein the valve configuration (2) is of two-stage construction and has a pilot control stage.

15. The control device of claim 9, wherein the valve configuration (2) has two electrically actuable pressure-reducing valves.

16. The control device of claim 9, wherein a separate control system is provided for each valve (5, 6) for the purpose of adjusting the start of control by the feedback device.

* * * * *